United States Patent [19]

Stewart

[11] 3,967,395

[45] July 6, 1976

[54] CROSSING UNDERCUTTER AND SWITCH UNDERCUTTER MOUNTED ON TRACTOR-TYPE VEHICLE

[75] Inventor: John Kenneth Stewart, Columbia, S.C.

[73] Assignee: Canron, Inc.

[22] Filed: Apr. 4, 1974

[21] Appl. No.: 458,021

[52] U.S. Cl. ..... 37/104; 171/16

[51] Int. Cl.[2] ..... E01B 27/04; E02F 3/08

[58] Field of Search ..... 37/104, 105, 106, 107; 171/16; 214/138 R

[56] References Cited

UNITED STATES PATENTS

| | | | |
|---|---|---|---|
| 2,847,134 | 8/1958 | Slate | 214/138 C |
| 3,019,536 | 2/1962 | Kershaw | 37/104 |
| 3,436,848 | 4/1969 | Peppin et al. | 37/104 |
| 3,624,936 | 12/1971 | Yard | 37/104 |

*Primary Examiner*—Edgar S. Burr
*Assistant Examiner*—R. E. Suter

[57] ABSTRACT

An undercutting apparatus for removing ballast and other material from beneath railroad ties, particularly ties in areas that are difficult to undercut with conventional equipment. The apparatus includes a carrier capable of moving over ordinary ground. An undercutter in the form of a toothed chain moving around the periphery of a plate member is rigidly mounted to a first frame member. A drive motor is provided for driving the chain by means of a sprocket. The first frame member is mounted on a second frame to pivot about a vertical axis with respect to the second frame. A motor and interconnecting gears are provided to pivot the first frame member as desired. The second frame is mounted on a travelling frame mounted on a vertically oriented track frame. Hydraulic cylinders pivot the second frame means as desired. The track frame is mounted to the carrier to transport the undercutter and provide it with the necessary power.

2 Claims, 9 Drawing Figures

FIG. 7
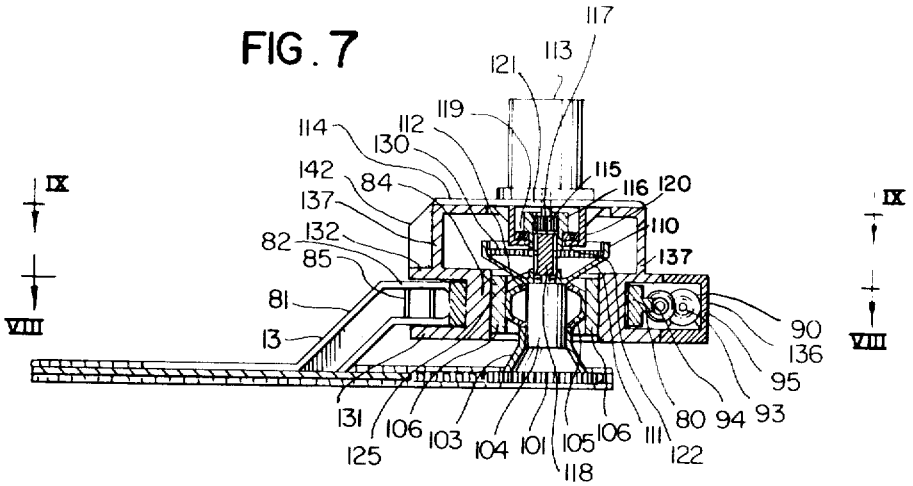
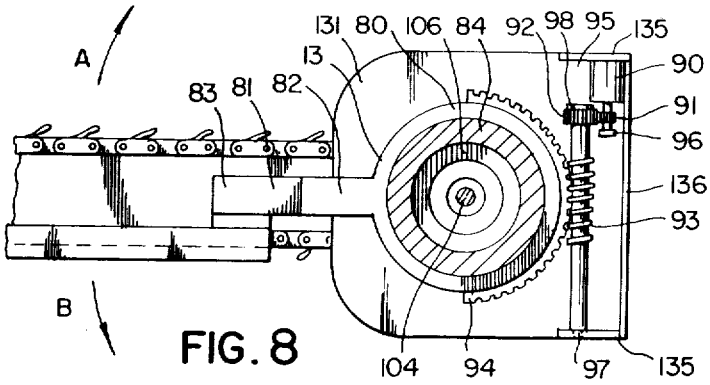
FIG. 8
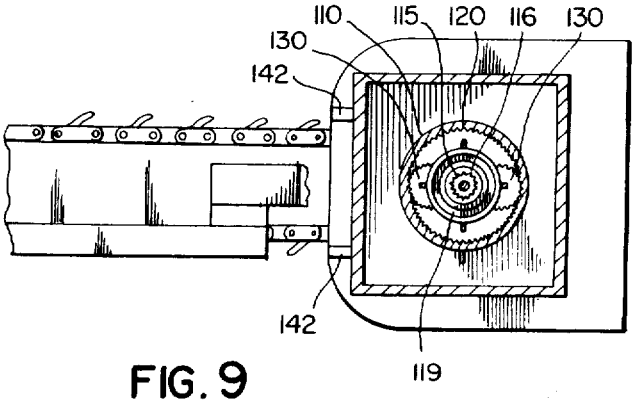
FIG. 9

CROSSING UNDERCUTTER AND SWITCH UNDERCUTTER MOUNTED ON TRACTOR-TYPE VEHICLE

This invention relates to undercutting apparatuses and in particular the type used in railroad construction and maintenance for removing ballast and other material from beneath ties and switches.

BACKGROUND OF THE INVENTION

Often during the construction, rebuilding or maintenance of railroads, it is necessary to remove ballast or other material from beneath railroad ties. This task of removing ballast becomes more difficult in locations where two or more tracks meet and railroad switches are used. At such locations the ties themselves may be extra long and the steel rails run at odd angles with respect to the ties and other rails. Because of the great variety of track layouts encountered, it is difficult to develop an undercutting apparatus having the necessary flexibility in its manoeuvres to permit the apparatus to remove the ballast from beneath and between the ties no matter what layout of tracks and ties exists. Many, if not all, of the known machines for removing ballast do not have this flexibility and are capable of removing the ballast only along an ordinary stretch of railroad track where no switches occur. Often hand tools and manual labour must be resorted to in order to remove the ballast at switch locations and this is time consuming and expensive.

Accordingly it is an object of the present invention to provide an undercutting apparatus mounted on a carrier capable of moving over ordinary ground and having the necessary flexiblity in movement of the ballast removing means to remove ballast from beneath and between railroad ties even where railroad switches are located.

It is another object of the present invention to provide ballast removing means mounted on a carrier capable of moving over ordinary ground and which is mounted in such a manner that it can be pivoted about a number of axes.

If is a further object of the undercutting apparatus of the present invention to provide a carrier capable of moving over ordinary ground with an undercutter capable of digging itself into the railbed adjacent the ties and then being pivoted so that the ballast removal means or undercutter lie in a horizontal plane beneath or beside the ties.

SUMMARY OF THE INVENTION

According to the invention, an undercutting apparatus for removing ballast from beneath solid structures comprises a carrier capable of moving over ordinary ground, a first frame member pivotable about a vertical axis, ballast removing means for removing said ballst from beneath said solid structures, said removing means including an elongated plate member and a chain member mounted to slide about at least a substantial portion of the periphery of said plate member, said ballast removing means being supported by said first frame member, means for driving said ballast removing means, a second frame means on which said first frame is mounted to pivot about said vertical axis with respect to said second frame member, pivot means for pivoting said first frame member and thereby pivoting said ballast removing means, a travelling frame member and a track frame member on which said travelling frame member is mounted, means for moving said travelling frame member vertically with respect to said track frame member, said second frame means being pivotable about a generally horizontal axis and pivotally connected to said travelling frame member, said track frame member being pivotally connected to said carrier, means for pivoting said second frame means about said horizontal axis, means for pivoting said track frame member on said carrier about a second generally horizontal axis which is perpendicular to the first mentioned horizontal axis, whereby in operation said carrier is moved along one side of the structure to be undercut and said ballast removing means is moved beneath said structure to remove said ballast.

BRIEF DESCRIPTION OF DRAWINGS

The following is a description, by way of example, of certain embodiments of the present invention, reference being had to the accompanying drawings in which:

FIG. 7 is a sectional side elevation taken along the line VII-VII of FIG. 6 of the ballast remomving means and the apparatus for pivoting the ballast removing means, FIG. 8 is a sectional plan view taken along the line VIII-VIII of FIG. 7 and showing the gears and motor for pivoting the first frame member, FIG. 9 is a sectional plan view taken along the line IX-IX of FIG. 7 and showing the reducing gears for driving the chain member of the ballast removing means.

DETAILED DESCRIPTION OF PREFERRED EMBODIMENTS

Figure 1:
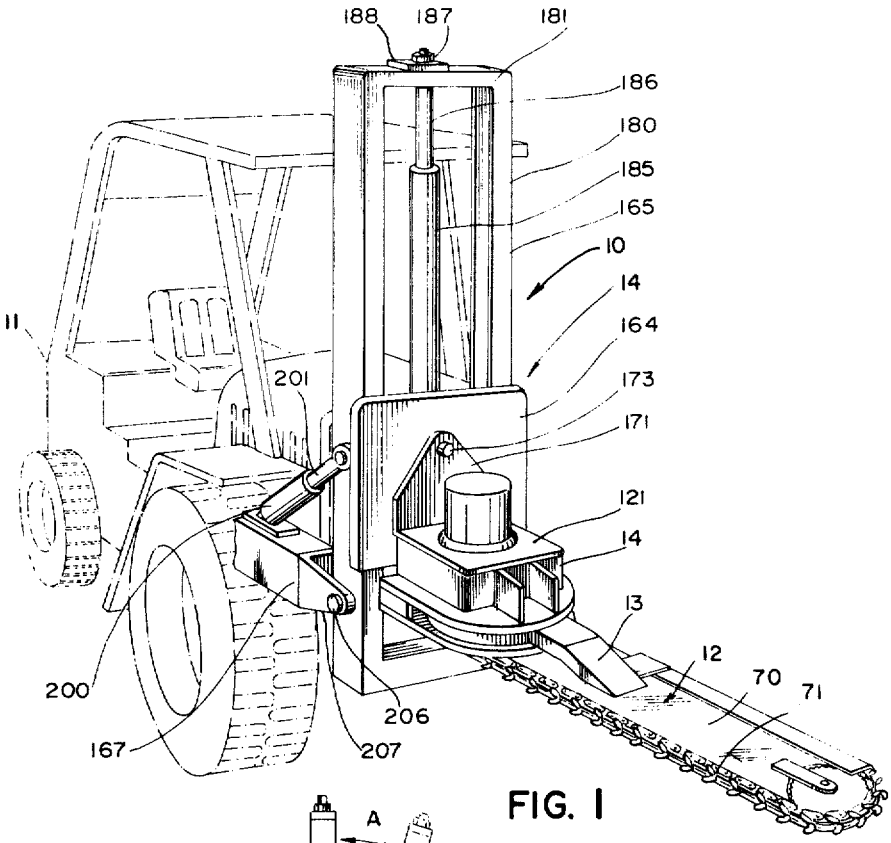
FIG. 1 is a perspective view of the undercutting apparatus of the present invention including a carrier.

FIG. 1 illustrates the preferred embodiment of the undercutting apparatus of the present invention generally designated by 10 and including a carrier 11. This undercutting machine is capable of removing ballast, debris, and other material from between and beneath solid structures such as railway ties. The ballast removing means 12 is mounted on the carrier by a combination of frame members and related structure in such a manner that the ballast removing means 12 can be manipulated by control means (not shown) either operated by the operator of the carrier 11 or by another person located near the ballast removing means. The ballast removing means can be manoeuvered into such a position that it is capable of digging itself into the roadbed even where complex switches are located. The ballast removing means may then be brought underneath or between the railroad ties in order to remove the ballast from underneath or between the ties. The frame or structural members used to connect the ballast removing means 12 to the carrier 11 generally comprise a pivotable first frame member 13 which is connected to a second frame means 14 to pivot about a vertical axis.

The present invention employs ballast removing means 12 in the form of a flat, rigid, elongated plate member 70 and a flexible chain member 71 mounted to slide about the periphery of the plate member 70. The plate member 70 is rigidly attached to the first frame member 13. The first frame member 13 is in turn pivotally attached to the second frame means 14 which includes an upright plate 171 and a top wall member 121. The plate 171 is rigidly connected at its bottom edge to wall member 121 and is mounted to slide up and down along track member 165 on travelling frame member 164. The track frame member 165 is pivotally mounted to two support arms 167, only one of which is shown in the drawings and each of which is rigidly mounted to one side of the carrier 11. It will be seen that the ballast removing means 12 of this undercutting apparatus is mounted in such a manner that it can be pivoted about at least two different axes, these axes including a vertical axis and a horizontal axis. Because of the manner in which the ballast removing means can be manoeuvered, the ballast removing means can be inserted, even in difficult locations, into the roadbed to remove ballast from beneath and between railroad ties.

The upright plate 171 and top member 121 can be formed from a rigid plate member bent approximately at its center to form a right angle. Alternatively, two separate plate members may be welded at a right angle with respect to each other. As can be seen in FIG. 1, the upright portion or plate 171 is formed with a triangular upper portion and has a hole 172 (see FIG. 4) formed in its uppermost corner. A horizontal shaft 173 extends through a hole in the travelling frame member 164 and through the hole 172 in the upright plate 171. The upright plate 171 is rigidly fixed to the shaft 173 so that rotation of the shaft 173 will cause a corresponding rotation of the upright portion. The shaft is however rotatably mounted in the travelling frame member 164 and suitable bearing means may be provided between the shaft and the member 164 to prevent undue wear due to rotation of the shaft.

Figure 4:
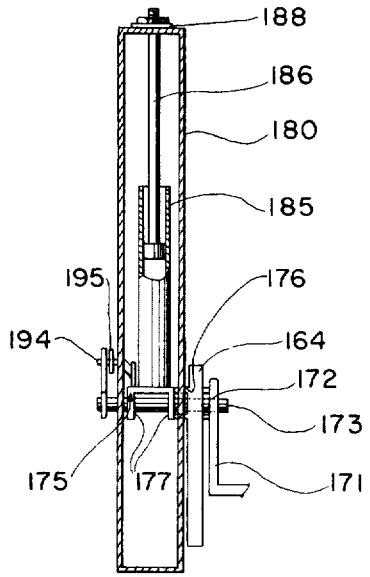
FIG. 4 is a sectional side view taken along the line IV-IV of FIG. 3 illustrating portions of the second frame means.

As shown in FIG. 4, the travelling frame member 164 is rigidly attached to a channel member 175 or other suitable structural member by means of the connecting member 176 which extend between one of the two downwardly extending sides 177 of the channel member 175 and the upper portion of the travelling frame member 164. The connecting member 176 may comprise bolts or studs or they may simply be projecting structural members welded to one side of the channel member.

The channel member 175 is mounted to slide up and downwards in the track frame member 165 which comprises two upright, long channel members 180 and two relatively short, horizontal channel members 181. Together the four channel members 180 and 181 form a rigid rectangular frame with one of the short channel members extending between the upper ends of the long channel members 180 and the other short member 181 extending between the bottom ends of the long members 180. Each end of the sliding channel member 175 enters into the upright channel formed by one of the long channel members 180 so as to be guided by the sides of the channel member 180. Suitable wheels 182 may be mounted at each end of the channel member 175 so as to rotably engage the bottom of the channel formed by the member 180. In addition, an extension can be rigidly attached to the top of each end of the channel member 175 if desired to help maintain the channel member 175 perpendicular to the channel members 180. Thus, each extension (not shown) would extend vertically upwardly a short distance with its inside surface immediately adjacent and parallel to the bottom of the channel formed by the channel member 180.

In this undercutting apparatus lift means are provided for raising and lowering a portion of the second frame means 166, the first frame member 13, and the ballast removing means 160. The lift means are provided by the hydraulic cylinder 185 and hydraulic piston 186. Hydraulic hoses (not shown) are of course attached to the hydraulic cylinder 185 in order to feed or remove hydraulic fluid from the interior of this cylinder. The upper end of the hydraulic piston 186 is rigidly connected to the upper channel member 181 by means of a nut 187 threaded on to a threaded end portion of the piston 186. The region of the channel member 181 beneath the nut 187 is strengthened by means of a rigid plate member 188 which extends across a central portion of the channel member 181. The plae member 188 is disposed between the upper surface of the channel member 181 and the bottom of the nut 187. The bottom end of the hydraulic cylinder 185 is rigidly connected to the horizontal channel member 175 at the center thereof. It will be readily seen that movement of the piston 186 in the hydraulic cylinder 185 will cause a corresponding movement of the channel member 175, the travelling frame member 164, and the upright plate 171. Full extension of the piston 186 to the end of hydraulic cylinder 185 results in the channel member 175 being moved to the bottom of the track frame member 165. In this position, the ballast removing means 160 is disposed beneath the surface of the ground or the roadbed where it can be pivoted about the vertical axis so that ballast can be removed from beneath the ties of the roadbed.

Figure 3:
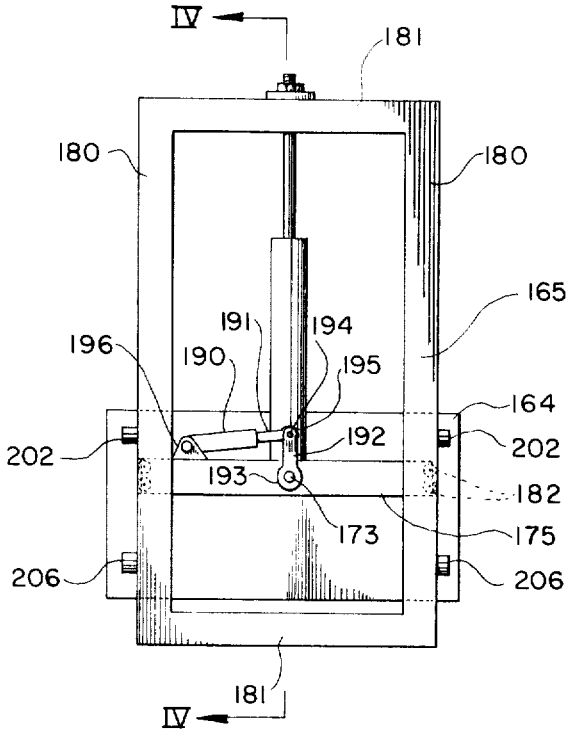
FIG. 3 is a rear elevation of the undercutting apparatus of FIG. 1 showing only the track frame member of the second frame means.

Pivot means are provided for pivoting the upright plate 171 with respect to the travelling frame member 164. The pivot means include a hydraulic cylinder 190, a hydraulic piston 191, and a crank arm 192, all of which can best be seen in FIG. 3 of the drawings. The bottom end of the crank arm 192 is rigidly attached to the rear end of the shaft 173 which projects rearwardly a short distance from the rear of the track frame member 165. It should also be noted that the center portion of the shaft 173 is rotatably mounted in the channel member 175 so that the shaft 173 moves upwardly or downwardly when the channel moves in either of these directions. The bottom end of the crank arm 192 is formed in the shape of a ring 193 and the rear end of the shaft 173 is inserted into this ring and then welded or otherwise secured thereto. A pin member 194 may be welded to the upper end of the crank arm 192 so as to extend parallel to the shaft 173. The outer end of the hydraulic piston 191 is then pivotally connected to the pin member 194. To accomplish this result, the outer end of the piston may have a ring member 195 welded thereto. The forward end of the pin member 194 is then inserted into the hole of the ring member 195 in which it is free to rotate. The closed end of the hydraulic cylinder 190 is pivotally connected to the sliding channel member 175 so that the hydraulic cylinder 190 and piston 191 are capable of moving with the channel member 175. A pivot support member 196 extends upwardly a short distance from the rear of the top surface of the channel member 175. The end of the hydraulic cylinder 190 is connected to the support member 196 by means of a pin member (not shown) extending from the cylinder into a hole formed in the pivot support member 196. Again, suitable hydraulic hoses are connected to the hydraulic cylinder 190 to operate the cylinder and piston. Outward movement of the piston 191 with respect to the cylinder will pivot the crank arm in the clockwise direction as seen from the rear of the track frame member 165. This will cause a corresponding pivoting movement of the upright plate 171 and first frame member 13 connected indirectly thereto. Inward movement of the piston 191 will of course cause the upright plate 171 to be pivoted in the opposite direction.

As stated earlier, the present invention also permits the second frame means 14 to be pivoted with respect to the support arms 167 and pivot means are provided for carrying out this pivotal movement of the second frame means. The pivot means comprise two hydraulic cylinders 200 and two hydraulic piston 201. Each hydraulic cylinder 200 and its co-operating hydraulic piston 201 is mounted to one side of the carrier 168 with the outer end of the hydraulic piston 201 being pivotally attached to the adjacent long channel member 180 of the track frame member 165. The closed end of each hydraulic cylinder 200 is pivotally attached to its respective support arm 167. Projecting outwardly a short distance from the side of each of the channel members 180, there is a cylindrical shaft member 202. The outer end of each of the pistons 201 is formed in the shape of a ring and has a cylindrical hole formed therein. Each of the shaft members 202 is inserted into the hole formed in the outer end of one of the pistons 191 and is free to rotate therein. Projecting upwardly from the upper surface of each support arm 167, there is a further pivot support member 203, the bottom end of which is rigidly attached to the support arm 167. A pin member 204 is inserted in a hole in each of the support members 203 and the closed end of the hydraulic cylinder 200 is connected to this pin member 204 so as to permit pivotal movement between the support member 203 and the cylinder.

Figure 2:
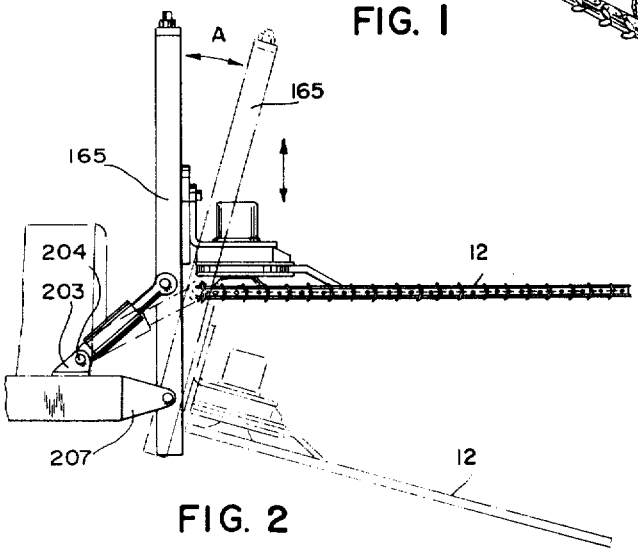
FIG. 2 is a side view of the undercutting apparatus of FIG. 1 showing the manner in which the ballast removing means can be manipulated.

A relatively short distance upwards from the bottom of the track frame member 165 is the location of two further shaft members 206. Each shaft member 206 projects outwardly a short distance from the side of one of the long channel members 180. Two tongues 207, only one of which is shown in the drawings, having the shape of an isosceles triangle project outwardly from the front end of the carrier 11, each tongue 207 forming part of one of the support arms 167. The front end of each tongue 207 has a cylindrical hole formed therein and each shaft member 206 is fitted snuggly into one of these holes. Each shaft member 206 is free to pivot in the hole formed in the tongue 207. As can be seen clearly from FIG. 2, outward movement of the hydraulic pistons 201 with respect to their hydraulic cylinders 200 will cause the track frame member 165 to be pivoted outwardly in the direction indicated by the arrow A from the position shown in solid lines to the position shown in dotted lines. The outward position of the track frame member 165 shown in FIG. 2 would, for instance, be utilized when the ballast removing means 12 is being inserted into the roadbed. During this operation, the ballast removing means would be lowered by means of the hydraulic cylinder 185 and piston 186 to the lower position shown in dotted lines in FIG. 11. In this position, only the forward end of the ballast removing means would come in contact with the ballast. As the ballast removing means worked itself into the roadbed, the track frame member 165 would be gradually brought to the upright position shown in FIGS. 1 and 2. When the track frame member 165 is in the upright position, the length of the ballast removing means is disposed horizontally so as to permit removal of ballast from beneath horizontal ties.

Figure 5:
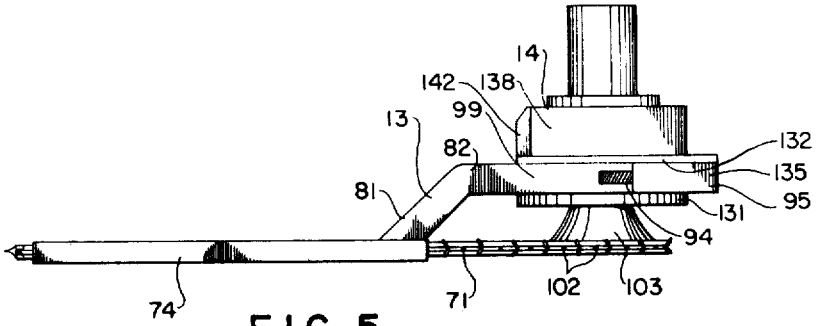
FIG. 5 is an enlarged side elevation showing the manner in which the ballast removing means, the first frame member, and the second frame means are interconnected.
Figure 6:
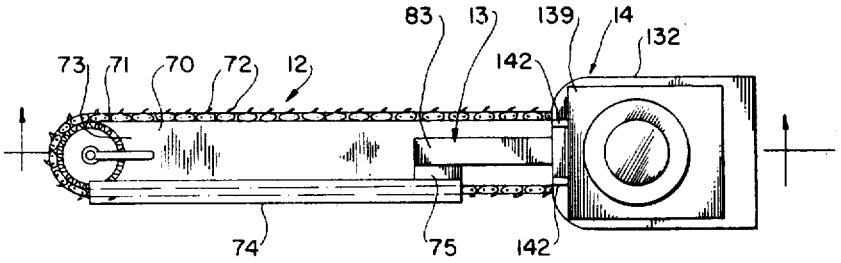
FIG. 6 is a plan view of the ballast removing means and frame members shown in FIG. 5.

Turning now to FIG. 5 and 6 of the drawings teeth members 72 are distributed along the length of the chain member 71 to engage the ballast as the chain member moves about the plate member. The outer end 73 of the plate member 70 has a toothed idler sprocket mounted thereof which engages the chain member and rotates with the chain member. The plate member 70 must be sufficiently rigid and strong to withstand the heavy loads exerted on it during operation of the undercutting apparatus. The plate member 70 is rigidly attached at one end to the first frame member 13 which supports the plate member.

Preferably one side of the ballast removing means 12 and the chain member 71 is enclosed in a guard or cover 74. The guard 74 prevents the teeth 72 moving along one side of the ballast removing means from moving ballast or debris towards the end 73. Frequently, it is desirable to prevent this from occurring as it may result in the ballast being moved towards the area from which one wishes to remove the ballast or debris. The guard 74 consists of an elongated U-shaped member extending from approximately the region in which the plate member 70 is connected to the first frame member 13 to the region immediately adjacent the rounded end 73. The guard 74 may be rigidly connected to both the bottom and the top of the plate member 70 if this is desired. A plate member 75 may also extend directly between the guard 74 and the first frame member 13 in order to provide a good, rigid connection for one end of the guard 74. It is understood of course that the interior of the guard 74 must be of sufficient cross-sectional area to permit easy passage of the chain member 71 along its length.

The apparatus shown in FIGS. 5 and 6 provides means for pivoting the ballast removing means at least 180 degrees in a horizontal plane with respect to the second frame means 14. The first frame member 13 is pivotally mounted in the second frame means 14 as can be seen from FIGS. 7 and 8 of the drawings. The first frame member 13 consists of four basic parts or sections including a cylindrical portion 80 (see FIG. 8), a sloping portion 81, an interconnecting straight portion 82 and a connecting portion 83. Each of these portions except the last portion has spaced apart upper and lower wall members and interconnecting side walls rigidly connect the upper and lower wall members. The cylindrical portion 80 has a cylindrical hole in its center through which passes a tubular frame member 84 forming part of the second frame means 14. The cylindrical portion 80 is mounted to pivot about the exterior surface of this frame member 84. The interconnecting straight portion 82 rigidly connects one side of the cylindrical portion 80 to the sloping portion 81 while the connecting portion 83 provides additional means for connecting the bottom end of the sloping portion 81 to the top of the plate member 70. Connecting portion 83 may consist of a rigid plate member securely fastened to the plate member 70 and may be an integral part of the plate member forming the top wall of the sloping portion 81. To provide additional strength in the first frame member, support ribs 85, only a couple of which are shown in FIG. 7, may be provided in the interior of the first frame member which extend between the walls of the member.

Pivot means are provided to pivot the first frame member 13 and thus the plate member 70 about a vertical axis defined by the center axis of the cylindrical portion 80. These pivot means comprise a motor 90, pinion gears 91 and 92, worm 93 and worm wheel member 94, which can best be seen in FIG. 8. The motor 90, preferably an electric motor, is rigidly mounted in a housing 95 which forms part of the second frame means 14. From one end of the motor 90 extends a shaft to which the pinion gear 91 is rigidly mounted. The end of the shaft opposite the motor 90 may be rotatably supported by a bracket member 96 rigidly fastened to the housing 95. The pinion gear 91 engages the larger gear 92 mounted at one end of the worm shaft. One end of the worm shaft is rotatably mounted in the side of the housing 95 at 97 while the other end may be rotatably mounted in a bracket member 98 similar to the bracket member 96. The threads of the worm 93 engage the sloping teeth of the worm wheel 94 which is rigidly mounted about the periphery of the cylindrical portion 80 of the first frame member. It will be noted that the worm wheel member 94 forms a semi-circular arc so that the first frame member can be rotated 90° in either the direction shown by the arrow A or the direction shown by the arrow B. It will be seen from FIG. 5 that the second frame means 14 is open in the region 99 so as to permit this rotation of the first frame member to take place in either direction. Suitable stop means are preferably provided to prevent the worm 93 from attempting to rotate the first frame member 13 more than 90 degrees in either direction. It will of course be understood that the present invention is not limited to providing a ballast removing means capable of rotating through 180°. Greater rotation of the ballast removing means are of course quite possible using an alternative construction to that shown in the drawings.

The present invention provides means for driving the ballast removing means which, as stated earlier, includes the chain member 71. In the preferred embodiment shown in the drawings, the drive means include a sprocket member 101 which is rotatably mounted to and beneath the second frame means 14 and located generally beneath the first frame member. The teeth 102 on the sprocket member 101 engage holes in the chain member 71 as shown in FIG. 5. The plate member 70 of the ballast removing means is mounted on the first member 13 so as to pivot about the central axis of the sprocket member 101. It will also be noted that the plate member 70 always lies in the same plane as the sprocket member 101. Thus, the plate member 70 and the sprocket member 101 together operate to form the support means for the chain member 71 and co-operate to form ballast removing means capable of rotation through 180 degrees in a horizontal plane even during actual movement of the chain member about the sprocket member and the plate member 70.

The sprocket member 101 is securely fastened to a funnel-shaped member 103. The bottom portion of the member 103 has downwardly diverging walls, the bottom ends of which are rigidly secured to the top side of the sprocket member 101. The upper portion of the member 103 comprises a vertically extending cylindrical wall which surrounds and is securely fastened to the bottom end of a cylindrical shaft 104. Bearing means 105 rotatably support the shaft 104 and are themselves supported in a cylindrical support member 106. The cylindrical support member 106 is rigidly secured in a centrally located hole extending vertically through the tubular frame member 84. The bearing means 105 are preferably taper roller bearings of known construction and are located both near the top end of the shaft 104 and near the center of the shaft 104. Because of the inclination and arrangement of the bearing means 105, the bearing means are capable of supporting the shaft member 104 both in the up and down direction as well as in every horizontal direction.

A large internal gear 110 shown in FIG. 7 and 9, is mounted to the upper end of the shaft 104. The internal gear 110 is supported on the shaft 104 by means of an interconnecting conical support member 111. The conical support member 111 has upwardly diverging walls, the bottom sides of which are rigidly connected to the top end of the shaft 104. Suitable shoulders 112 may be formed at the junction between the wall of the support member 111 and the upper end of the shaft 104 so as to permit the upper bearing means 105 to provide suitable support for the shaft 104 and the internal gear 110 in the vertical direction. The upper side of the wall of the support member 11 is either rigidly attached to the bottom side of the internal gear 110 or the wall of the support member 111 is formed integrally with the internal gear 110.

Suitable means shown in FIGS. 7 and 9 are provided for driving the internal gear 110 and thus rotate the shaft 104 and sprocket member 101. A motor 113 is rigidly secured to the top of housing 114 which surrounds the various gears for driving the internal gear 110 and the internal gear 110 itself. The housing 114 forms part of the second frame means 14 of the undercutting apparatus. A shaft extends vertically downwardly from the motor 113 and to the bottom end of this shaft a pinion gear 115 is fixed. Surrounding this gear 115 is a small internal gear 116, the top end of which forms a ring around the pinion gear 115. Teeth are arranged about the inside of the ring of the internal gear 116 and intermesh with the teeth of the pinion gear 115. The ring portion of the internal gear 116 is supported on a horizontal bottom portion 117, the periphery of which is surrounded by the ring-shaped portion. Extending downwardly from the bottom portion 117 there is a shaft or skirt 118. An annular shoulder is formed about the bottom of the bottom portion 117 by the shaft 118. This annular shoulder rests on bearing means 119. The bearing means 119 rotatably engage the shaft or skirt 118 so as to permit the shaft 118 and the inernal gear 116 to rotate freely about their central axis without undue wear. The bearing means 119 are mounted in and are supported by the bottom end of a cylindrical housing 120. The cylindrical side walls of the housing 120 are supported at the top by a top wall member 121 of the housing 114. Extending inwardly from the bottom end of the cylindrical side walls of the housing 120 is an annular flange 122. The inner edge of the flange 122 is adjacent the shaft or skirt 118 which rotates in the hole formed by the flange 122. The bearing means 119 are supported on the annular flange 122 between the shaft 118 and the cylindrical sidewalls of the housing 120.

The shaft 118 extends vertically downwardly towards the shaft 104 and is supported at its lower end in a cylinder 125. The cylinder 125 extends vertically upwardly from the top end of the shaft 104 on the inside of the conical support member 111. The cylinder 125 may be formed integrally with the support member 111 or may be welded thereto. The cylinder 125 may enclose bearing means for the bottom end of the shaft 118 but, in any case, prevents horizontal movement of the lower end of the shaft.

The portion of the shaft or skirt 118 between the upper end of the cylinder 125 and the bottom of the annular flange 122 is provided with suitable teeth to form a gear. This gear formed on the shaft 118 engages planetary gears 130 mounted between the gear on the shaft and the internal gear 110. These planetary gears engage the teeth of the internal gear 110 so as to rotate the internal gear 110 when the shaft 118 is rotated. The arrangement of the pinion gear 115, internal gear 116, the gear on the shaft 118, the planetary gears 130 and the internal gear 110 is such that the speed of the internal gear 110 is considerably less than the speed of rotation of the pinion gear 115. The arrangement of gears thus provides speed reducing means to permit the motor 113 to drive its shaft at a relatively high speed while the sprocket member 101 rotates at a relative low speed. Such speed reducing means is of course desirable in order to provide the sprocket member with sufficient power to drive the ballast removing means during the removal of ballast from beneath ties and other solid structures.

The second frame means 14 will now be described in greater detail with reference to FIG. 5, 6 and 7 in particular. The tubular frame member 84 is surrounded by relatively flat frame members 131 and 132 which may beformed integrally with the tubular frame member 84 or may be rigidly attached thereto. Frame member 131 is attached at the inside to the bottom end of the tubular member 84 while frame member 132 is attached to the top end of the tubular member. The bottom frame member 131 supports the bottom of the cylindrical portion 80 and at least a portion of the bottom of the straight portion 82 of the first frame member 13. The frame member 131 also provides a turning table on which the first frame member is pivoted. The upper frame member 132 extends parallel to the lower frame member 131 and its bottom surface lies adjacent the top of the cylindrical portion 80 of the first frame member 13. The upper frame member 132 also provides support for the first frame member and it prevents the first frame member from being pushed upwardly on the tubular frame member 84. Attached to the rear of the frame members 131 and 132 is the housing 95 for the pivot means used to pivot the first frame member about the tubular frame member 84. This housing 95 consists of two side walls 135 and a rear wall 136. the side walls 135 only extend forwardly from the rearwall 136 a sufficient distance to enclose the motor 90 and the worm 93. They thus permit the first frame member 13 to be pivoted 90 degrees in either direction A or direction B from the position shown in FIG. 8. The roof and floor for the housing 95 may simply be formed from extensions of the flat frame members 132 and 131 respectively.

Attached to the top of the frame member 132, there is the housing 114 for the various reducing gears. The housing 114 comprises front and rear walls 137, side walls 138, and the top wall member 121. The bottom end of each of the front and rear walls 137 and the side walls 138 is rigidly attached to the upper surface of the frame member 132. Flanges extend inwardly a short distance from the top of the front and rearwalls 137 and the top wall member 121 is rigidly attached to the front and rear walls 137 by means of these flanges.

Various braces may be provided to strengthen the second frame means and these include the two brace members 142. The brace members 142 consist of plate members, each welded along one side to the front wall 137 and along another side to the frame member 132. These brace members thus provide additional support for the front wall 137.

The undercutting apparatus of the present invention is very efficient. for removing ballast from between and beneath railway ties and because the ballast removing means can be pivoted in various directions, the ballast removing means can be inserted in locations which are difficult to get at with ordinary undercutting machines. The ballast removing means 12 can be inclined with respect to the horizontal for insertion in the roadbed and then when the ballast removing means has dug itself into the roadbed, the ballast removing means may be pivoted to a horizontal position beneath the railroad ties for removing the ballast beneath them. The ballast removing means can be lifted or lowered in the vertical direction a considerable distance with respect to the carrier 11. A further advantage of the present invention is the ability which it has to pivot the ballast removing means in a horizontal plane through as much as 180 degrees (or 90 degrees in either direction) in order to place the ballast removing means beneath the ties. Thus, a great volume of ballast may be removed by moving the carrier 11 along one side of the solid structure or track to be undercut with the ballast removing means operating beneath the structure or track as it moves along.

What I claim is:

1. An undercutting apparatus for removing ballast and other material from beneath solid structures comprising a carrier capable of moving over ordinary ground, a first frame member pivotable about a vertical axis, ballast removing means for removing said ballast from beneath said solid structures, said removing means including an elongated plate member and a chain member mounted to slide about at least a substantial portion of the periphery of said plate member, said ballast removing means being supported by said first frame member, means for driving said ballast removing means, a second frame means on which said first frame member is mounted to pivot about said vertical axis with respect to said second frame means, pivot means for pivoting said first frame member about said vertical axis and thereby pivoting said ballast removing means, a travelling frame member and a track frame member on which said travelling frame member is mounted, means for moving said travelling frame member vertically with respect to said track frame member, said second frame means being pivotable about a primary axis, which is generally horizontal when said track frame member is in an upright position, and pivotally connected to said travelling frame member, said track frame member being pivotally connected to said carrier, means for pivoting said second frame means about said horizontal axis, means for pivoting said track frame member on said carrier about a second generally horizontal axis which is perpendicular to said primary axis, whereby in operation said carrier is moved along one side of the structure to be undercut and said ballast removing means is moved beneath said structure to remove said ballast.

2. An undercutting apparatus according to claim 1 wherein said second frame means includes two plate members disposed perpendicularly to each other and rigidly connected to each other.

* * * * *